US005826782A

United States Patent [19]

Stout

[11] Patent Number: 5,826,782

[45] Date of Patent: Oct. 27, 1998

[54] CARTON AND A HANDLE THEREFOR

[75] Inventor: James T. Stout, Ellijay, Ga.

[73] Assignee: The Mead Corporation, Dayton, Ohio

[21] Appl. No.: 871,927

[22] Filed: Jun. 10, 1997

[51] Int. Cl.[6] ..... B65D 5/468

[52] U.S. Cl. ..... 229/117.13; 206/427; 229/117.14; 229/117.22

[58] Field of Search ..... 206/140, 141, 206/427, 434; 229/117.12, 117.13, 117.14, 240, 242, 117.22

[56] References Cited

U.S. PATENT DOCUMENTS

| | | | |
|---|---|---|---|
| 3,994,432 | 11/1976 | Kirby, Jr. | 229/117.13 |
| 4,637,515 | 1/1987 | Wilson et al. | 206/434 |
| 4,830,267 | 5/1989 | Wilson | 206/427 |
| 5,221,041 | 6/1993 | Stout et al. | 229/117.13 |
| 5,307,932 | 5/1994 | Stout et al. | 206/141 |
| 5,320,277 | 6/1994 | Stout et al. | 229/117.13 |
| 5,379,944 | 1/1995 | Stout et al. | 229/117.13 |
| 5,385,234 | 1/1995 | Stout et al. | 206/427 |
| 5,395,044 | 3/1995 | Stout | 229/117.13 |
| 5,427,242 | 6/1995 | Oliff et al. | 206/430 |
| 5,480,091 | 1/1996 | Stout | 229/117.14 |
| 5,482,203 | 1/1996 | Stout | 229/117.13 |
| 5,595,292 | 1/1997 | Bates | 206/158 |
| 5,647,483 | 7/1997 | Harris | 206/427 |
| 5,772,030 | 6/1998 | Baxter | 206/427 |

FOREIGN PATENT DOCUMENTS 2 522 619 9/1983 France .

*Primary Examiner*—Gary E. Elkins
*Attorney, Agent, or Firm*—Thomas A. Boshinski

[57] ABSTRACT

A carton formed from sheet material for containers such as cans or bottles includes a top wall, a pair of side walls and a bottom wall interconnected to form a tubular structure. A notional strip is defined along the top wall, having notional side edges, and extends between the end edges and has a width less than the distance between the side edges. A pair of hand apertures, each having at least one aperture edge, are defined in the top panel and disposed along opposite sides of the notional strip with at least a portion of the aperture edges disposed generally along the notional side edges. A plurality of preformed tear lines, one of the tear lines extending along an adjacent one of the notional side edges from substantially adjacent each end of each of the apertures toward a respective one of the top panel end edges but terminating at a termination point disposed remotely therefrom. At least one score line is defined in the top panel to extend generally from each of the termination points to an adjacent corner of the top panel.

6 Claims, 6 Drawing Sheets

CARTON AND A HANDLE THEREFOR

BACKGROUND OF THE INVENTION

The present invention relates generally to paperboard cartons for use in packaging articles. It is particularly useful for cartons for packaging containers such as cans or bottles for beverages, although the invention is not limited in this regard. More particularly, the invention relates to a handle for such cartons.

Containers such as cans or bottles for beverages including soft drink, beer, juices and the like are commonly sold in multiple quantities packaged in a paperboard carton. For the convenience of the consumer, the carton is often provided with a handle, which quite commonly includes as a primary feature one or two slots or other apertures formed in the carton. These slots are commonly formed into a top all of the carton. The user inserts the hand or fingers into one or both of the slots to lift the carton. Many varieties of handles of this type are known in the art.

Lifting a carton containing beverage cans or bottles introduces considerable stress into the paperboard from which the carton is formed. For this reason, and to prevent tearing of the paperboard and failure of the carton, a large number of carton handles have been devised over the years which include various reinforcement structures, aperture arrangements and locations, stress-directing fold lines, stress-relieving slits and the like.

Recently, attempts have been made to introduce into the marketplace beverage cartons wherein cans are arranged in two tiers, with corresponding cans from each tier being axially aligned. An example of such a carton can be seen by reference to U.S. Pat. No. 5,427,242. Such cartons are intended to hold relatively large numbers of cans, for example 24 to 36 cans. The contained weight of these cartons makes use of reinforced handle structures particularly advantageous.

Moreover, despite the many handle designs which have been previously developed, there is always a need for handles with improved performance. A stronger handle may permit the use of larger cartons for packaging heavier loads, as well as the possibility of a smaller blank or lighter paperboard material. In view of the large numbers of cartons which are produced, the costs savings which can be realized from these latter advantages can be significant.

SUMMARY OF THE INVENTION

In accordance with one embodiment, the present invention provides a carton formed from sheet material for packaging containers such as cans or bottles, including a top wall having opposed side edges and opposed end edges, and a pair of side walls, one of the side walls being connected to each side edge of the top wall. A bottom wall is connected between the side walls to complete a tubular structure. A notional strip is defined along the top wall, having notional side edges, and extends between the end edges and has a width less than the distance between the side edges.

A pair of hand apertures, each having at least one aperture edge, are defined in the top panel and disposed along opposite sides of the notional strip with at least a portion of the aperture edges disposed generally along the notional side edges. A preformed tear line extends along one of the notional side edges from substantially adjacent the aperture toward one of the top panel end edges but terminates at a termination point disposed remotely therefrom. At least one score line is defined in the top panel and extends generally from the termination point to an adjacent corner of the top panel.

A plurality of preformed tear lines may be provided, with one of the tear lines extending along an adjacent one of the notional side edges from substantially adjacent each end of each of the apertures toward a respective one of the top panel end edges but terminating at a termination point disposed remotely therefrom. At least one score line is defined in the top panel to extend generally from each of the termination points to an adjacent corner of the top panel.

The carton may further comprise a reinforcing strip secured to an inner surface of the top panel, the reinforcing strip being disposed generally along the notional strip.

Each of the tear lines may terminate at the termination point in a generally J-shaped cut extending away from the notional strip.

A plurality of score lines may be defined on the top panel to extend from each of the termination points toward the respective one of the corners, the score lines being arranged in a diverging arrangement toward the corner. A cut line may be disposed substantially across each of the corners, the diverging score lines terminating at the cut line.

DETAILED DESCRIPTION OF THE PREFERRED EMBODIMENT

Figure 1:
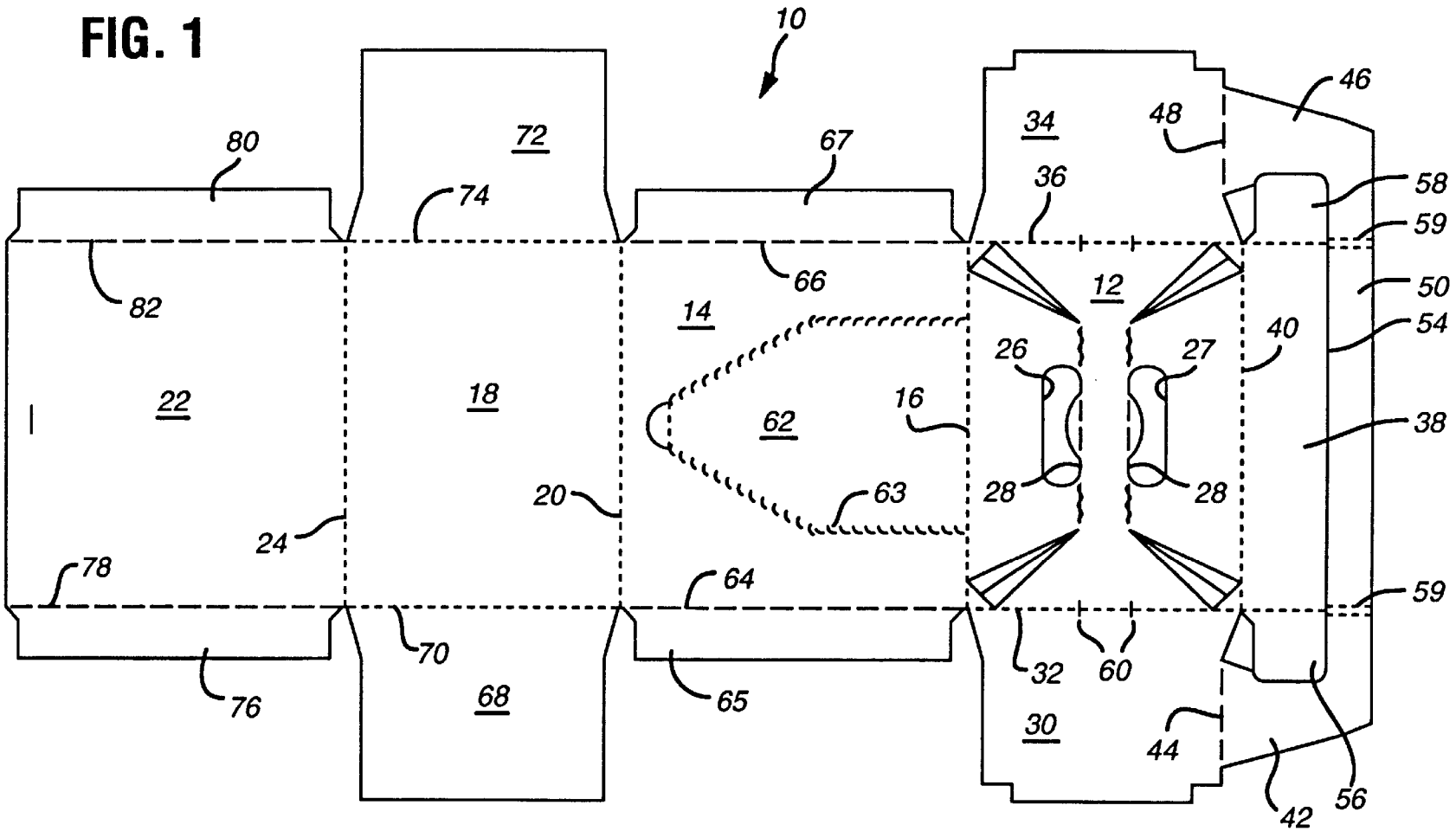
FIG. 1 is a plan view of the inner surface of a blank for forming a carton having a handle in accordance with the present invention.

A carton 10 for use in connection with the present invention may be seen in blank form by reference to FIG. 1, in which the inner surface of the blank is shown. The carton includes a top wall panel 12 connected to a side wall panel 14 along fold line 16. A bottom wall panel 18 is connected to side wall panel 14 along fold line 20, and at its opposite side is connected to side wall panel 22 along fold line 24.

A major end flap 30 is connected at one end edge of top wall panel 12 along fold line 32, while a second major end panel 34 is connected at the opposite end of top wall panel 12 along fold line 36. A glue flap 38 is connected to top wall panel 12 along fold line 40.

Side wall panel 14 includes a removable access panel 62 defined by a perforated tear line 63. Connected at one end edge of side wall panel 14 along fold line 64 is a minor end flap 65, and connected by a fold line 66 at an opposite end edge is minor end flap 67.

Bottom wall panel 18 has a major end flap 68 connected along fold line 70 at one end edge thereof, while a second major end flap 72 is connected at an opposite end edge along fold line 74.

Finally, side wall panel 22 includes a minor end flap 76 connected at one end edge along fold line 78, and a minor end flap 80 connected along fold line 82 at the opposite end edge.

Top wall panel 12 includes a pair of hand apertures 26 and 27 for forming a portion of a handle structure for the carton. These apertures are generally oval, each having an inner edge 28. These apertures and other portions of the handle structure are discussed in greater detail below.

A handle reinforcing structure in accordance with the present invention is connected to each of major end flaps 30 and 34, and comprises end portion 42 connected to major end flap 30 along fold line 44, and end portion 46 connected to major end flap 34 along fold line 48. A central portion 50 interconnects end portions 42 and 46. Central portion 50 is positioned adjacent to glue flap 38, separated therefrom along a cut line 54.

Glue flap 38 includes end flap 56 which extends into end portion 42, and end flap 58 which extends into end portion 46.

End portions 42 and 46 are connected to the central portion 50 of the reinforcing strip along fold lines 59 which are debossed so as to protrude inwardly of the erected carton. These debossed areas mate with an area along respective ones of fold lines 32 and 36 which are encased by torque relief slits 60 to thereby reduce tension along the outer surfaces of the fold lines between top wall panel 12 and major end flaps 30 and 34. Further details regarding this structure may be found by reference to U.S. Pat. No. 5,320,277, which is incorporated herein by reference.

An additional reinforcing strip (not shown) may optionally be added to the handle reinforcing structure, disposed between central portion 50 and glue flap 38. Such a reinforcing structure may be seen in U.S. Pat. No. 5,482,203, which is incorporated herein by reference.

Figure 2:
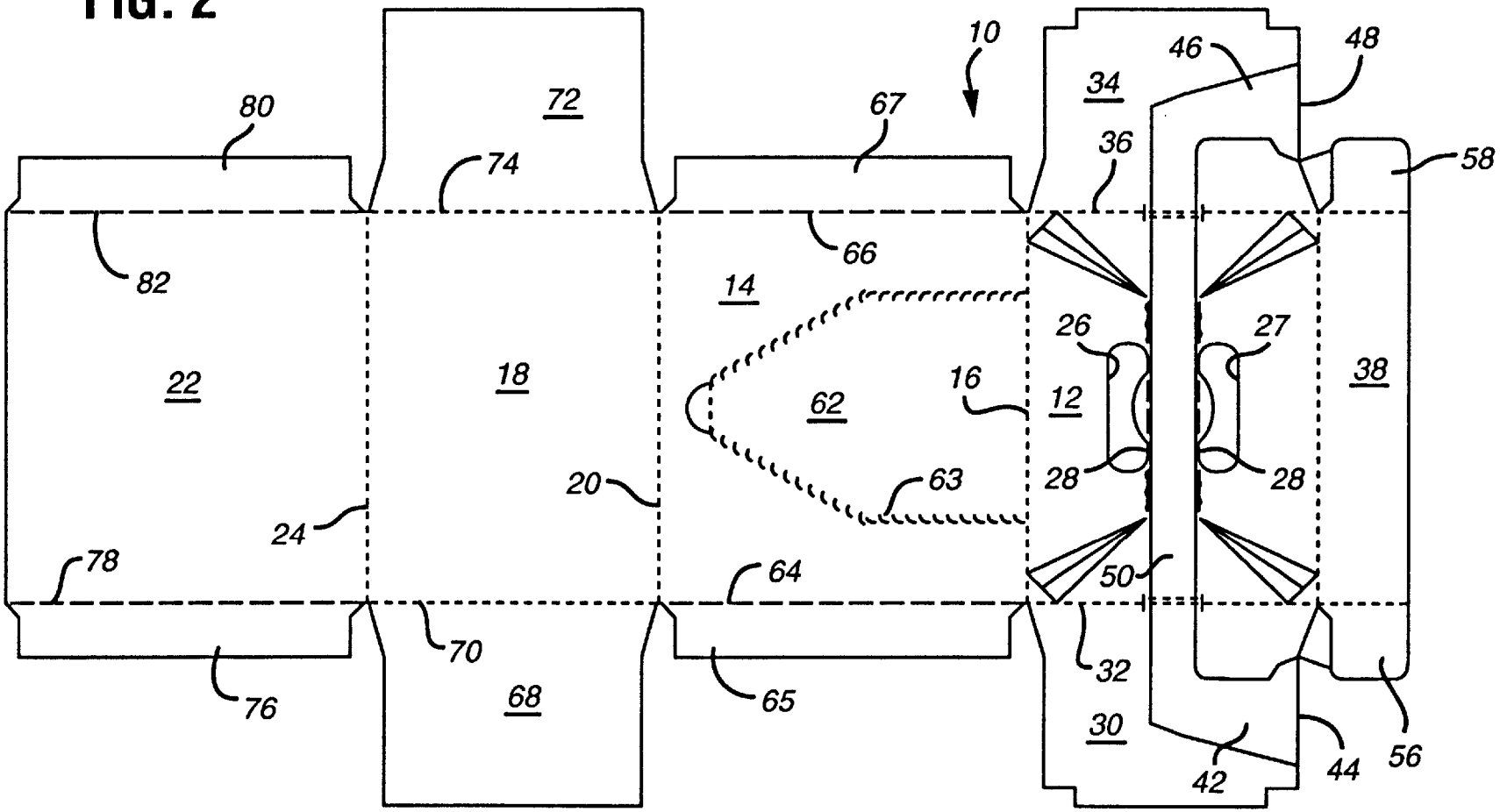
FIG. 2 is a partial plan view similar to FIG. 1, showing a first step in the formation of a carton from the blank of FIG. 1.

Referring now to FIG. 2, a portion of the blank for carton 10 can be seen, showing the beginning of the assembly process for the carton. The handle reinforcing structure is folded about fold lines 44 and 48, and end portions 42 and 46 are glued to major end panels 30 and 34, respectively. Central portion 50 is glued to top wall panel 12, so as to extend along the region between the hand apertures 26 and 27. Thus, a double-ply reinforced structure between the apertures 26 and 27 is formed.

When central portion 50 is positioned on the underside of central panel 12 as shown in FIG. 2, a notional strip can be defined along central panel 12, extending between its end edges. This notional strip passes between the hand apertures 26 and 27, with its edges aligned with the inner edges 28 of apertures 26 and 27.

Figure 3:
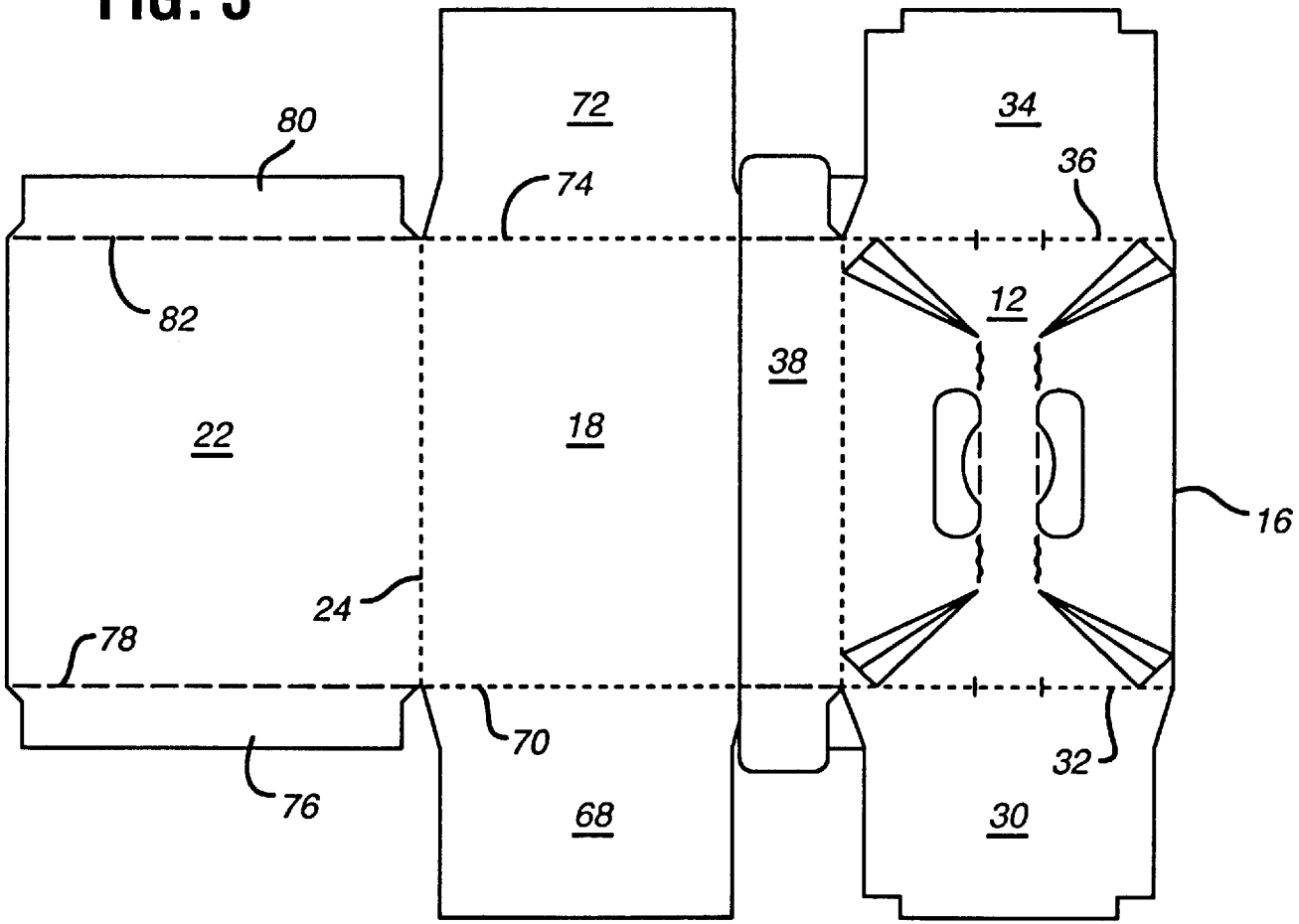
FIGS. 3 and 4 are plan views of the blank of FIGS. 1 and 2, further illustrating the formation of the carton.
Figure 4:
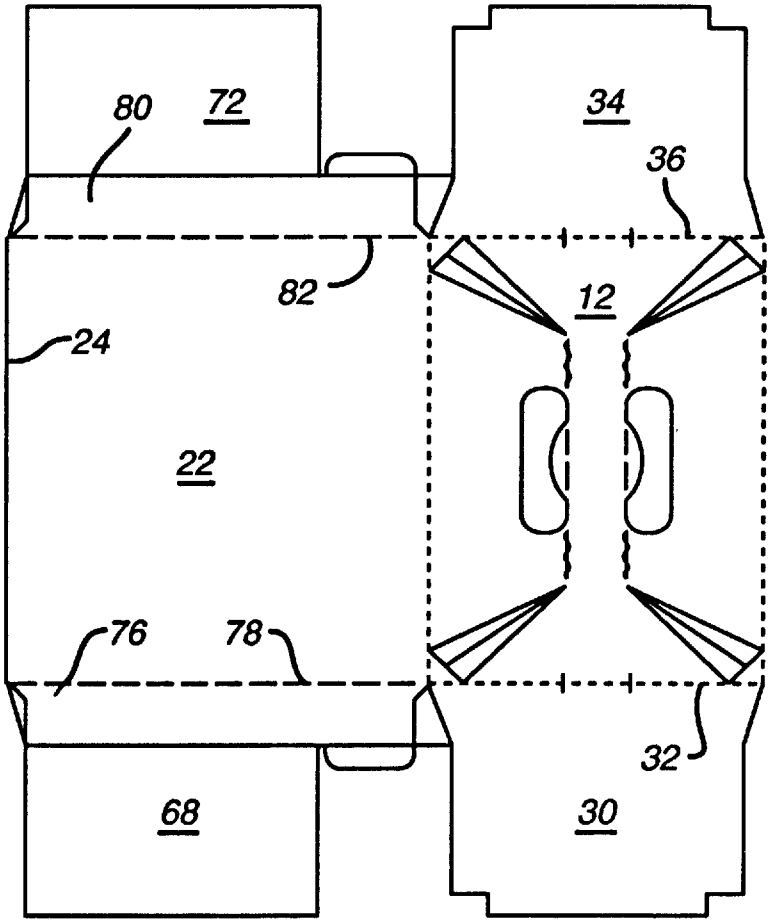

The remainder of the assembly of carton 10 can be seen by reference to FIGS. 3 and 4. In FIG. 3, the top wall panel 12 is shown folded along fold line 16 into overlapping arrangement with side wall panel 14. Glue is applied along glue flap 38 and, as shown in FIG. 4, side wall panel 22 is folded along fold line 24. The upper edge of side wall panel 22 is then adhered to glue flap 38 to complete the collapsed carton.

Figure 5:
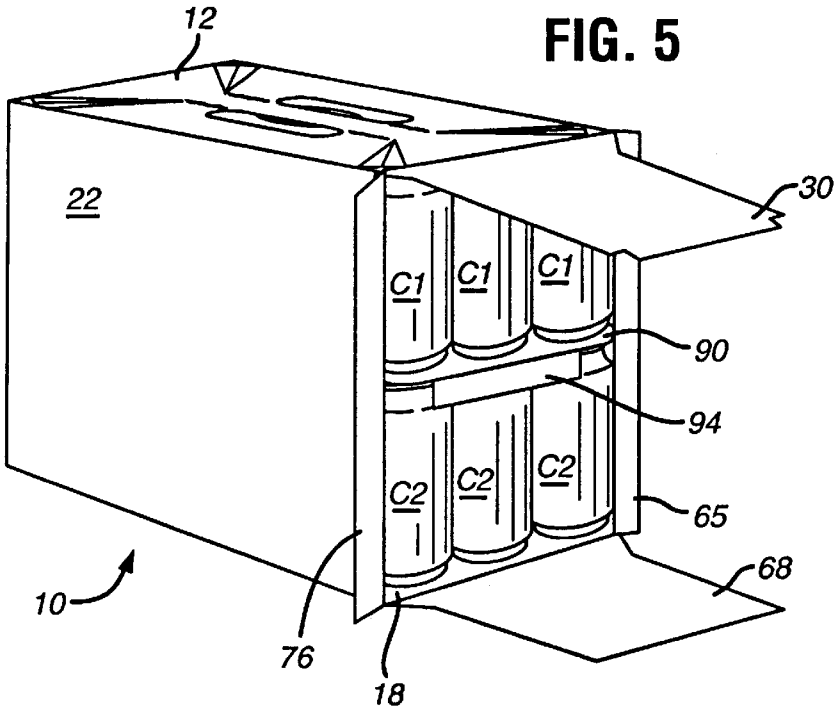
FIG. 5 is a three-quarter view of the top, side and end of an erected and loaded carton formed from the blank of FIG. 1, showing the end closure structure prior to folding and sealing.

The carton is loaded as shown in FIG. 5. First, the carton is erected into a tubular structure. The carton 10 is shown with its end closure structure, comprising major end flaps 30 and 68 and minor end flaps 65 and 76, open prior to the application of glue for sealing. The carton is loaded, as shown here for example, with beverage cans arranged into two tiers. A divider insert 90 is positioned between the tiers. Cans C1 of the upper tier are positioned on insert 90, which in turn rests upon the tops of the cans C2 of the lower tier. Cans C2 are in turn positioned on the bottom wall panel 18 of the carton 10. The can arrangement, as is conventional, is assembled prior to loading, and the stacked and arranged cans are loaded by pushing into the carton tube through one or both of its open ends. Such operation may be carried out by suitable, commercially-available automated packaging machinery.

Closure and sealing of the end closure structure is effected in the following manner. Minor end flaps 65 and 76 are folded to a closed position against the packaged cans. Glue is applied to minor end flaps 65 and 76 and, preferably, to end flap 94 attached along a fold line to the edge of insert 90. Major end flap 30 is then folded downwardly and secured to the flaps 65, 76 and 94. Additional glue is applied to the outer end of the inner surface of major end flap 68, which is folded upwardly and sealed to major end flap 30.

An identical operation is carried out to close and seal end closure structure located at the opposite end of the carton. (In a preferred embodiment of the invention, the carton is loaded from one end only using automated packaging machinery. During such a loading operation, The opposite, non-loaded carton end is closed and sealed before the cans are pushed into the carton.)

Figure 6:
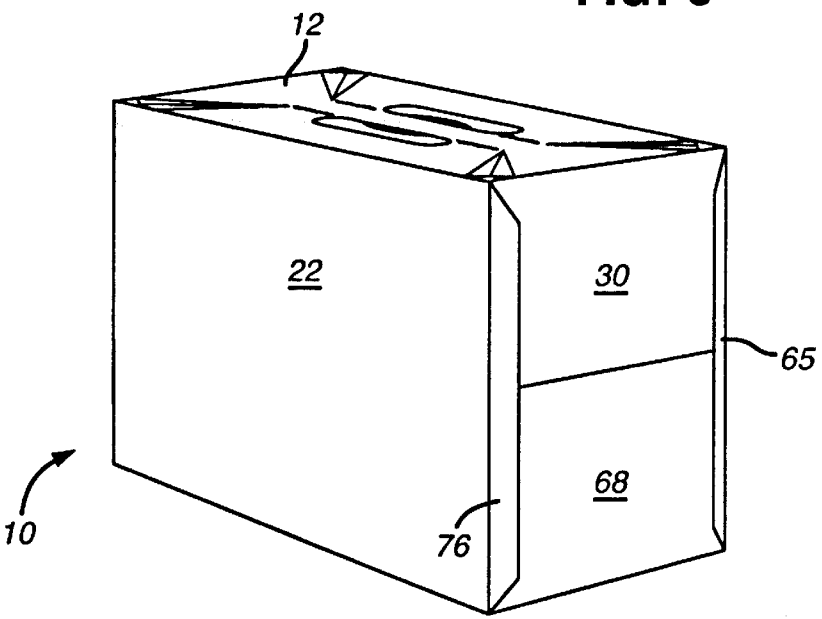
FIG. 6 is a view similar to FIG. 5, but showing the end closure structure sealed to form the finished carton.

The loaded and sealed carton may be seen by reference to FIG. 6.

Figure 7:
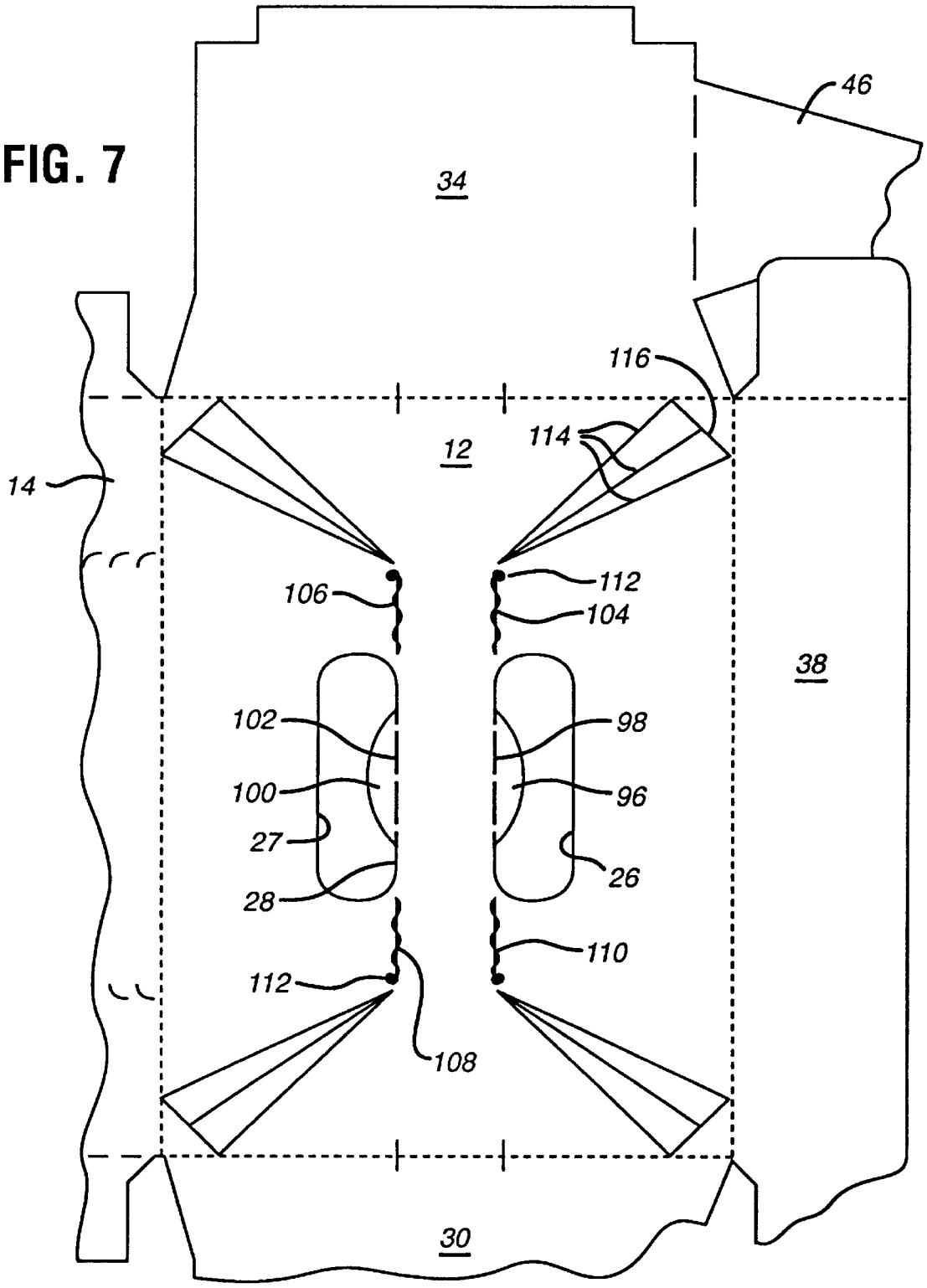
FIG. 7 is an enlarged view of the top panel portion of the blank shown in FIG. 1.

The handle arrangement formed on panel 12 may be seen in greater detail by reference to FIG. 7. A cushion flap 96 is disposed along the inner edge 28 of aperture 26, connected to panel 12 by fold line 98. A similar cushion flap 100 is connected to panel 12 by fold line 102. It will be recognized that in the completed carton, the fold lines 98 and 102 will lie substantially along the side edges of the underlying central portion 50 of the reinforcing strip.

A plurality of preformed, perforated tear lines 104, 106, 108 and 110 extend from the apertures 26 and 27 along a line defined by the edge of the underlying central portion 50 of the reinforcing strip, or in other words, by the inner edge 28 of the adjacent aperture. Each tear line 104, 106, 108 and 110 extends away from the respective aperture 26 or 27 and toward the end edge of top panel 12. The tear line then terminates, remote from the end edge of panel 12, in a "J"-shaped cut 112 which turns away from the central portion of panel 12 and generally back towards the hand apertures 26 and 27.

A plurality of stress-diverting score lines 114 are formed into panel 12 to extend from each J-shaped cut 112 at the end of a tear line toward the respective corner of top wall panel 12, in a manner similar to that taught in U.S. Pat. No. 5,307,932, which is incorporated herein by reference. For example, one group of score lines extend in diverging fashion from a point adjacent the end of tear line 104 generally toward the corner of panel 12 adjacent end flap 34 and side panel 14. A cut line 116 extends diagonally across the corner, at which the group of score lines 114 terminates. Similar groups of score lines extend from adjacent the ends of tear lines 106, 108 and 110 toward the respective corners of top panel 12.

In the specific embodiment disclosed, three diverging score lines are shown in each group. However, other arrangements of score lines may be used with the handle disclosed herein. For example, conventional, single score lines extending toward each corner may be used. Alternatively, the multiple-score line arrangements shown in U.S. Pat. Nos. 5,379,944 or 5,385,234 may be used. Still other arrangements could be used.

It will also be recognized that it is possible to use the handle of the present invention with a carton having "beveled" corners such as the carton shown in the embodiment of FIGS. 8–12 in the above referenced U.S. Pat. No. 5,307,932.

In use, when lifting the loaded carton for the first time, a user inserts the hand and/or fingers into one or both of the apertures 26 and 27 and grasps the portion of panel 12 therebetween. The user then lifts the carton. The weight of the carton causes tear lines 104, 106, 108 and 110 to tear until the tearing is stopped by the J-shaped cuts 112. Further lifting deflects the tearing stress from the lines 104, 106, 108 and 110 and along score lines 114 toward the corners of top panel 12. This effectively converts tearing stress in the handle region to tensile stress along the score lines 114.

Lifting of the carton along the line 118 causes the top panel 12 in its central region to bow upwardly, imitating the behavior of a conventional strap-style handle. (The "strap" is formed along the two-ply reinforced portion of the panel 12.) Because tearing in the top panel is controlled, overall tear-resistance is in fact improved. Not only is the handle of improved strength, but it also provides a comfortable "feel" for the user while lifting and/or carrying the carton.

It has been found that the tear lines 104, 106, 108 and 110 perform best when they extend into panel 12 and away from apertures 26 and 27 to a distance from approximately 20% to 60% of the distance from the edge of the aperture to the end edge of panel 12. More preferably, this distance may be within the range of 30% to 50%, and most preferably may be about 35% to 40%.

It should be readily recognized that while in the preferred embodiment, the present invention has been described in connection with a carton for packaging two tiers of cans, the handle structure may also be used with a carton for packaging only a single tier of cans, or for a carton for packaging bottles, jars or other containers or articles. The containers may be oriented vertically, as described herein, or horizontally.

Further, it should be recognized that various handle reinforcing means other than that described herein may be used with the disclosed handle. For example, rather than a single top panel 12 and the reinforcing structure comprising portions 42, 44 and 50, a lapped top panel of a type generally known in the art may be used. In such an embodiment, the overlap between the two top panel portions forms a double-ply strip which extends down the center of the carton top wall. An example of a carton of this type may be seen in U.S. Pat. No. 5,427,242, which is incorporated herein by reference. The handle structure is formed into the lapped top panel in the same manner as the handle structure described herein, as will be readily appreciated by those skilled in the art. In such an embodiment, the tear lines 104, 106, 108 and 110 are formed to extend along the edges of the lapped portion.

It will also be recognized that as used herein, directional references such as "top", "bottom", "end" and "side" do not limit the respective panels to such orientation, but merely serve to distinguish these panels one from another.

What is claimed is:

1. A carton formed from sheet material for containers such as cans or bottles, comprising:

a top wall having opposed side edges and opposed end edges;

a pair of side walls, one of the side walls connected to each said side edge of said top wall;

a bottom wall connected between said side walls to complete a tubular structure;

a notional strip defined along said top wall, having notional side edges, and extending between said end edges and having a width less than the distance between said side edges;

a pair of hand apertures, each having at least one aperture edge, defined in said top panel and disposed along opposite sides of said notional strip with at least a portion of said aperture edges disposed generally along said notional side edges;

a preformed tear line extending along one of said notional side edges from substantially adjacent said aperture toward one of said top panel end edges but terminating at a termination point disposed remotely therefrom; and at least one score line defined in said top panel and extending generally from said termination point to an adjacent corner of said top panel.

2. A carton formed from sheet material for containers such as cans or bottles, comprising:

a top wall having opposed side edges and opposed end edges;

a pair of side walls, one of the side walls connected to each said side edge of said top wall;

a bottom wall connected between said side walls to complete a tubular structure;

a notional strip defined along said top wall, having notional side edges, and extending between said end edges and having a width less than the distance between said side edges;

a pair of hand apertures, each having at least one aperture edge, defined in said top panel and disposed along opposite sides of said notional strip with at least a portion of said aperture edges disposed generally along said notional side edges;

a plurality of preformed tear lines, one of said tear lines extending along an adjacent one of said notional side edges from substantially adjacent each end of each of said apertures toward a respective one of said top panel end edges but terminating at a termination point disposed remotely therefrom; and at least one score line defined in said top panel extending generally from each of said termination points to an adjacent corner of said top panel.

3. A carton as defined in claim 2, further comprising a reinforcing strip secured to an inner surface of said top panel, said reinforcing strip being disposed generally along said notional strip.

4. A carton as defined in claim 2, wherein each of said tear lines terminates at said termination point in a generally J-shaped cut extending away from said notional strip.

5. A carton as defined in claim 2, wherein a plurality of score lines are defined on said top panel to extend from each of said termination points toward the respective one of said corners, said score lines being arranged in a diverging arrangement toward said corner.

6. A carton as defined in claim 5, further comprising a cut line disposed substantially across each of said corners, said diverging score lines terminating at said cut line.

* * * * *